US005691001A

United States Patent [19]

Ainali et al.

[11] Patent Number: 5,691,001

[45] Date of Patent: Nov. 25, 1997

[54] METHOD FOR SURFACE TREATMENT OF A METALLIC MATERIAL

[75] Inventors: Markku Sakari Ainali; Bror Thomas Johansson; Lena Marie-Louise Wickman, all of Västerås, Sweden

[73] Assignee: Outokumpu Cooper Oy, Espoo, Finland

[21] Appl. No.: 643,513

[22] Filed: May 6, 1996

[30] Foreign Application Priority Data

May 11, 1995 [FI] Finland ..... 952284

[51] Int. Cl.[6] ..... B05D 3/00

[52] U.S. Cl. ..... 427/398.1; 427/399; 148/269; 148/273

[58] Field of Search ..... 148/273, 269; 427/399, 398.1

[56] References Cited

U.S. PATENT DOCUMENTS 5,160,381 11/1992 Gervais ..... 148/269

5,376,190 12/1994 Hoveling ..... 148/269

*Primary Examiner*—Janyce Bell

*Attorney, Agent, or Firm*—Smith-Hill and Bedell

[57] ABSTRACT

The invention relates to a method for the surface treatment of a metallic material, the coating being designed for creating an artificial patina in a copper-bearing material after the material is installed in its final location of use. According to the invention, in connection with the filtering and washing stage, including at least one step, of the precipitate formed of the ingredient components of the coating material, the solids content of the precipitate is adjusted within the range of 15–50% by weight, as calculated from the weight of the coating material after the filtering stage, and the coating material with an adjusted solids content is stored at a temperature lower than 5° C. prior to applying said coating material onto the target surface.

8 Claims, No Drawings

METHOD FOR SURFACE TREATMENT OF A METALLIC MATERIAL

The present invention relates to a method for the surfacetreatment of a metallic material, particularly for treating the patination agent used for coating a copperbearing material so that said patination agent can be used even after having an essentially long shelf life.

In natural patination, which takes place in ordinary weather conditions, copper forms, within a relatively long period of time, a surface coating or a protective layer, called patina. In color, patina may be for instance brown or green, and it is customary to divide patina into different types, brown or green patina. Among the factors affecting the creation rate of patina, let us mention for instance atmospheric conditions and the relative position of the copper surface with respect to wind direction and prevailing weather. Because natural patina as such is not harmful for the copper surface, but on the contrary forms a protective layer thereon, various different agents and methods have been developed for speeding up the creation of patina.

From the Canadian patent 734,897,there is known a method and agent for creating artificial patina. The agent according to said CA patent 734,897 is formed so that there is first mixed an aqueous solution of copper nitrate and iron (III) sulfate with an aqueous solution of sodium hydroxide, and then the created precipitate is separated from the mother liquor and further washed with water in order to remove residual alkale. However, the patination agent according to the CA patent 734,897 must be used rapidly within the course of a few days after preparation in order to create the desired artificial patina on the copper surface in question. Weather conditions are an obstacle for the use of this type of patination agent, because the patination must be carried out in conditions essentially similar to the ones required for a painting job, i.e. in open air, during dry and warm weather.

When employing an artificial patination agent, it has been advantageous to coat the desired copper surface inside, for instance in the same premises where the copper surface was manufactured. However, when ready-patinated copper plates are installed for example on building roofs, it is necessary to bend the plate or make for instance fastening holes in the patinated surface, and fine patination agent particles may then be emitted therefrom. From the sanitary point of view, working in the fine dust caused by the patination agent is not recommendable, at least not without a respiratory mask. Moreover, the damages caused for the patina surface during installation and other treatments result in preservation problems.

The object of the present invention is to eliminate some of the drawbacks of the prior art and to achieve a more feasible method for the surface treatment of a metallic material, by means of which method the artificial patination agent employed as coating can be used after having an essentially long shelf life by applying the patination agent on the desired metal surface, during advantageous weather conditions, only in the final location of use. The essential novel features of the invention are apparent from the appended patent claims.

According to the invention, an agent used for artificial patination, said agent corresponding for example to the aqueous solution composition described in the CA patent 734,897,is treated so that the solids content of the created precipitate is adjusted, at least during the one-step filtering and washing stage, within the range of 15–50% by weight, advantageously 20–30% by weight as calculated from the weight of the material suited for patination after the filtering stage. This solids content is used for the consistency of the patination agent which is fine-controlled with extra water in order to consider the requirements of the covering methods and devices. Thus the patination agent, with an adjusted solids content, is arranged to be further stored at the refrigerator temperature or in a space with a temperature lower than 5° C., advantageously within the range 1°–5° C. The storage can also be taken place at the deep-frozen temperature within the range −15°—30° C. When the desired copper plate to be patinated is installed in place, it can advantageously be subjected to artificial patination—in advantageous weather conditions—with a patination agent processed according to the present invention, so that an advantageous adhesion and preservation are ensured on the treated surface.

The adjusting of the solids content of the patination agent according to the invention is advantageously carried out by means of a washing stage advantageously simultaneous to capillary filtering. In capillary filtering, the patination agent is formed on a fine porous absorption surface, wherethrough passes only the water or aqueous solution to be separated in filtering. Thus the filtering stage and the washing stage essentially connected thereto can advantageously be performed in one and the same step. For adjusting the solids content, other known filtering methods can also be used, but then it is advantageous to perform at least two successive filtering and washing steps.

According to the invention, when the patination agent is put to use, even after a long period of storage, the patination agent is first allowed to warm up to the temperature of use, whereafter water and/or sodium nitrate is added to the patination agent if necessary. Then the patination agent is subjected to mechanical agitation in order to achieve an essentially smooth patination sludge, and thereafter the patination agent is ready to be applied on the target surface. Prior to application, the object to be patinated must be oxidized. This is carried out either by allowing the target surface to be oxidized naturally in the prevailing weather conditions, or by oxidizing the surface artificially, for instance with sodium chlorite. After applying the patination agent, the surface to be patinated is dried, and there is advantageously sprayed sodium silicate in order to improve preservation, whereafter the surface is dried again. The application of the patination agent and the sodium silicate spraying are advantageously performed twice, but when desired, they can be performed several times.

In the above specification the invention is described with reference to one coating material composition only, but it is naturally clear that the invention can be applied for other corresponding coating material compositions within the scope of the appended claims.

We claim:

1. A method for surface treatment of an object of a copper bearing material, comprising the following steps:

(a) forming a precipitate by mixing an aqueous solution of at least one copper salt and an aqueous solution of an alkali metal hydroxide, (b) filtering and washing the precipitate, (c) adding water to the filtered and washed precipitate to form a sludge having a solids content from about 15% to about 50% by weight, and (d) applying the sludge as a patination agent to a surface of the copper bearing material, and wherein the method includes, after step (c), storing the sludge at a temperature below about 5° C. until just before step (d).

2. A method according to claim 1, wherein the filtering and washing step comprises a one-step capillary filtering.

3. A method according to claim 1, wherein the solids content of said sludge is from about 20% to about 30% by weight.

4. A method according to claim 1, comprising storing the sludge at a temperature from about 1° C. to 5° C.

5. A method according to claim 1, comprising storing the sludge at a temperature from about −15° C. to about −30° C.

6. A method according to claim 1, comprising warming the sludge before step (e).

7. A method according to claim 1, comprising adding water to the sludge and mechanically agitating the sludge before step (e).

8. A method according to claim 1, comprising adding sodium nitrate to the sludge and mechanically agitating the sludge before step (e).

* * * * *